US010428517B1

(12) United States Patent
Starks, Jr. et al.

(10) Patent No.: US 10,428,517 B1
(45) Date of Patent: Oct. 1, 2019

(54) ROOF ASSEMBLY RAKE PLATE RETAINER

(71) Applicant: Building Research Systems, Inc., Edmond, OK (US)

(72) Inventors: Richard G. Starks, Jr., Oklahoma City, OK (US); Ralph L. Herren, Newcastle, OK (US)

(73) Assignee: Building Research Systems, Inc., Edmond, OK (US)

( * ) Notice: Subject to any disclaimer, the term of this patent is extended or adjusted under 35 U.S.C. 154(b) by 0 days.

(21) Appl. No.: 15/923,849

(22) Filed: Mar. 16, 2018

Related U.S. Application Data

(60) Provisional application No. 62/481,446, filed on Apr. 4, 2017.

(51) Int. Cl.

| | |
|---|---|
| ***E04D 13/155*** | (2006.01) |
| ***E04B 1/41*** | (2006.01) |
| ***E04D 3/30*** | (2006.01) |
| ***E04D 3/36*** | (2006.01) |
| *E04B 7/10* | (2006.01) |

(52) U.S. Cl.
CPC ..... *E04B 1/40* (2013.01); *E04D 3/30* (2013.01); *E04D 3/36* (2013.01); *E04D 13/155* (2013.01); *E04B 7/102* (2013.01)

(58) Field of Classification Search
CPC . E04B 1/40; E04B 7/02; E04D 13/155; E04D 3/36; E04D 3/30
See application file for complete search history.

(56) References Cited

U.S. PATENT DOCUMENTS 1,354,867 A * 10/1920 Wright ..... E04D 13/15 52/62
2,282,631 A * 5/1942 Winship ..... E04B 2/58 248/217.3
2,558,720 A * 7/1951 Hansman ..... F16B 37/041 24/569
3,858,373 A * 1/1975 Day ..... E04D 3/364 52/520
3,889,437 A * 6/1975 Day ..... E04D 3/364 52/489.1
3,982,373 A * 9/1976 Wilson ..... E04D 3/30 52/90.1
3,998,019 A * 12/1976 Reinwall, Jr. ..... E04D 3/362 52/478
4,102,105 A * 7/1978 Taylor ..... E04D 3/30 52/394
4,248,021 A 2/1981 Dyer
4,420,913 A * 12/1983 Long ..... E04D 3/30 52/54

(Continued)

*Primary Examiner* — Brent W Herring
(74) *Attorney, Agent, or Firm* — Hall Estill Attorneys at Law

(57) ABSTRACT

Apparatus and associated method contemplating a roof assembly having a plurality of roof structurals. A rake plate having a panel flange is configured for attaching a roof panel thereto. A fastener connects the rake plate to the building structural. A rake plate retainer has a retention flange defining a fastener opening through which the fastener passes, and defines a standoff boss apart from the fastener that is configured to define a predetermined gap for the rake plate that permits operable movement of the rake plate relative to the building structural.

12 Claims, 11 Drawing Sheets

(56) References Cited

U.S. PATENT DOCUMENTS 4,435,937 A * 3/1984 Stone ..... E04D 3/3602 52/520
4,445,302 A * 5/1984 Dean ..... E04D 3/36 52/278
4,467,586 A * 8/1984 Long ..... E04D 3/30 52/748.1
4,522,005 A * 6/1985 Seaburg ..... E04D 3/362 52/520
4,682,454 A * 7/1987 Simpson ..... E04C 3/08 52/200
4,728,235 A * 3/1988 Patti ..... F16B 2/065 411/174
4,736,552 A * 4/1988 Ward ..... E04B 1/642 52/309.13
4,766,707 A * 8/1988 Knudson ..... B21D 28/36 52/715
4,796,403 A * 1/1989 Fulton ..... E04D 3/362 52/478
5,222,341 A * 6/1993 Watkins ..... E04D 3/362 52/478
5,606,838 A * 3/1997 Hughes ..... E04D 3/362 52/520
5,697,197 A * 12/1997 Simpson ..... E04D 3/364 52/462
5,743,063 A * 4/1998 Boozer ..... E04B 7/00 52/508
5,867,959 A * 2/1999 Ruble ..... E04D 3/3607 52/520
6,301,853 B1 * 10/2001 Simpson ..... E04C 3/08 52/520
6,889,478 B1 * 5/2005 Simpson ..... E04C 3/08 52/520
8,316,605 B2 * 11/2012 Oberg ..... E04D 3/3603 52/309.15
9,003,733 B1 * 4/2015 Simpson ..... E04D 3/364 52/478
9,725,916 B2 * 8/2017 McLain ..... E04G 21/3261
2011/0078973 A1 * 4/2011 Oberg ..... E04D 3/3603 52/582.1
2015/0259934 A1 * 9/2015 McLain ..... E04G 21/3261 182/137
2017/0237387 A1 * 8/2017 Hudson ..... E04D 3/366 52/173.3
2017/0237389 A1 * 8/2017 Hudson ..... E04D 3/366 136/251
2017/0237390 A1 * 8/2017 Hudson ..... E04D 3/366 136/251

* cited by examiner

ROOF ASSEMBLY RAKE PLATE RETAINER

FIELD OF THE INVENTION

The embodiments of this technology pertain to a roof assembly in a building structure and more particularly, but not by way of limitation, to floating structural components that compensate for loads by providing freedom for predetermined displacements between adjoining components.

BACKGROUND

Numerous types of roof assemblies are employed for pre-engineered buildings that are designed to provide adequate load and weather-element resistance. Typically, the favored solutions involve mating sheet metal structural components that are intentionally designed to displace with respect to each other to compensate for large loads imparted to the roof assembly that otherwise, without displacement, would plastically deform the sheet metal components.

A popular type of roof is a standing seam roof in which adjacent corrugated panel members are joined together edge-wise by interconnecting and then engaging them together to form an upright standing seam. The adjacent panels forming the standing seam are fixed together so that they do not displace with respect to each other, cooperatively creating a web having considerable diaphragm strength that can be employed to position and integrate with the underlying support structure. Preferably, the web at least to some extent is resiliently connected to the underlying support structure so that the web is intentionally displaceable (it "floats") to compensate for loads imparted to the roof such as wind, precipitation, and thermal loading. Without a robust ability to float in a pre-engineered way, the forces from repeated loadings can, over time, weaken and even separate the sheet metal connections, resulting in unsightly distortion, leaks, and even potential catastrophic pulling away of the roof from the underlying support structures.

Improvements are needed to the floating assemblies that connect the web of panels to the underlying support structures. It is to that need that embodiments of this technology are directed.

SUMMARY

Some embodiments of this technology contemplate a roof assembly having a plurality of roof structurals. A rake plate having a panel flange is configured for attaching a roof panel thereto. A fastener connects the rake plate to the building structural. A rake plate retainer has a retention flange defining a fastener opening through which the fastener passes, and defines a standoff boss apart from the fastener that is configured to define a predetermined gap for the rake plate that permits operable movement of the rake plate relative to the building structural.

Some embodiments of this technology contemplate a rake plate retainer operably joining a floating rake plate to a stationary building structural in a roof assembly. The rake plate retainer is configured to retain a predetermined lateral disposition of the rake plate relative to the building structural while permitting a longitudinal displacement of the rake plate relative to the building structural. The rake plate retainer has a flange defining a retention zone adjacent the rake plate, and further defines an opening. A standoff boss extends from the flange and is configured to limit an extent to which the flange is urged toward the rake plate as a result of a fastener passed through the opening and connected to the building structural.

Some embodiments of this technology contemplate a rake plate retainer operably joining a floating rake plate to a stationary building structural in a roof assembly. The rake plate retainer is configured to retain a predetermined lateral disposition of the rake plate relative to the building structural while permitting a longitudinal displacement of the rake plate relative to the building structural. The rake plate retainer has a first flange defining a retention zone adjacent one side of the rake plate, and further defines an opening. A second flange defines a second retention zone adjacent an opposing side of the rake plate. A standoff boss extends from one of the flanges and is configured to limit an extent to which the flanges are urged toward the rake plate as a result of a fastener passed through the opening and connected to the building structural.

DETAILED DESCRIPTION

Initially, this disclosure is by way of example only, not by limitation. The illustrative constructions and associated methods disclosed herein are not limited to use or application with any specific device or in any specific environment. That is, the disclosed technology is not limited to usage for connecting any particular type of roofing system members together as is disclosed in the illustrative embodiments. Thus, although the instrumentalities described herein are for the convenience of explanation, shown and described with respect to exemplary embodiments, the skilled artisan understands that the principles herein may be applied equally in other types of systems and environments involving floating structural systems.

Figure 1:
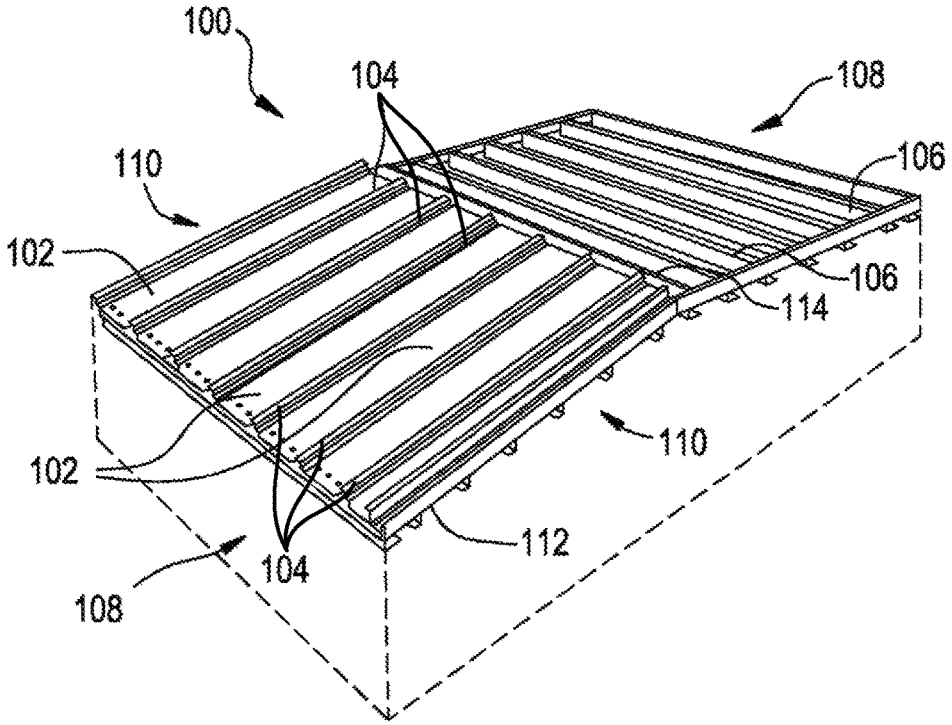
FIGS. 1 and 2 are isometric depictions of a roof assembly that is suited for practicing the floating plate technology disclosed herein.
Figure 2:
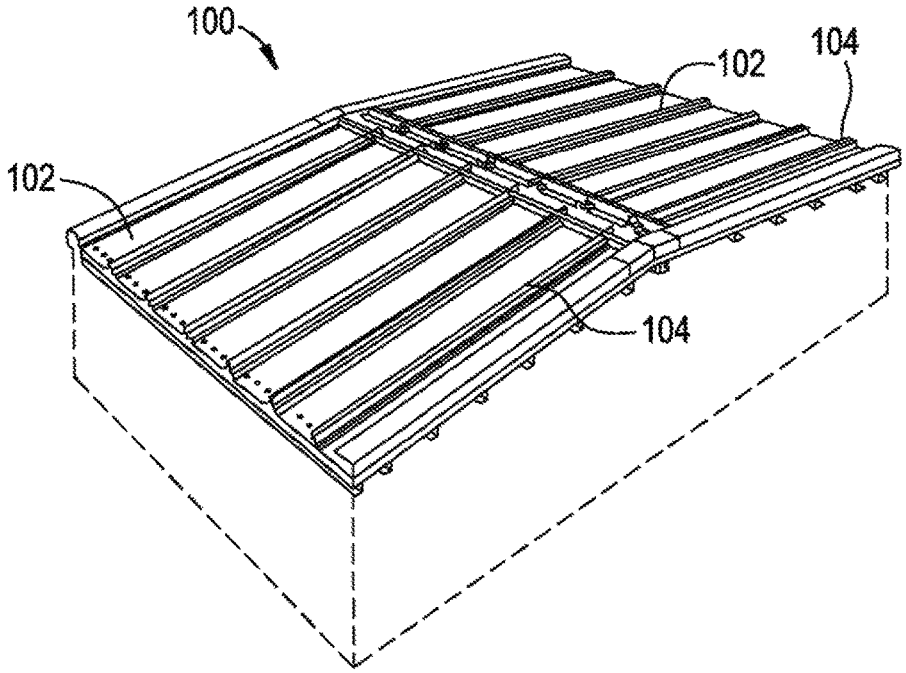

FIGS. 1 and 2 are isometric depictions of a roof assembly 100 constructed of a number of panel members (panels) 102 that are joined together by engaging the adjacent panel edges together to form standing seams 104. In FIG. 1 some of the panels 102 are removed from the roof assembly 100 to better depict how they are supported upon underlying roof structurals 106 that extend perpendicularly to the standing seams 104 in these illustrative embodiments. The roof assembly 100 in these illustrative embodiments forms opposing sidewall portions 108 and opposing gable roof portions 110. The gable roof 110 includes a building structural 112 (such as a rake structure) that extends continuously from the lower end of the sidewall 108 to the roof peak 114.

Figure 3:
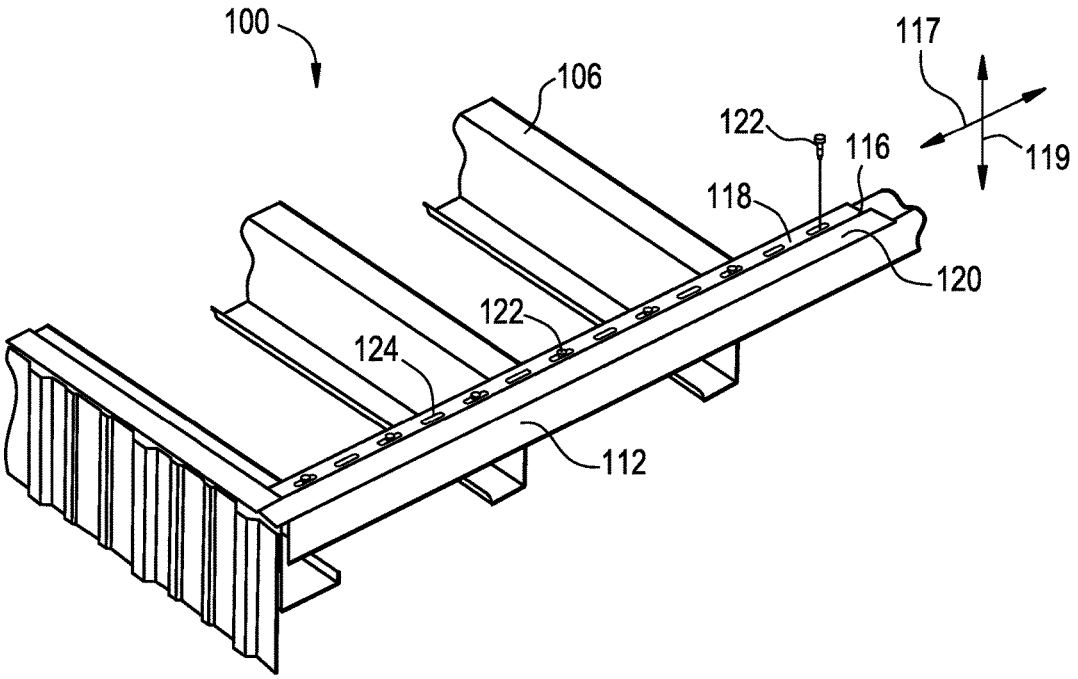
FIG. 3 PRIOR ART
FIG. 3 is an enlarged portion of the roof assembly depicted in FIG. 1 depicting a floating plate assembly constructed in accordance with previously attempted solutions.

FIG. 3 is a reoriented and enlarged isometric depiction of a portion of the roof assembly 100 of FIGS. 1 and 2, more clearly depicting the building structural 112 spanning the roof structurals 106. The building structural 112 is rigidly attached to each of the roof structurals 106, such as by using fasteners or welding and the like. A rake plate 116 has a base 118 portion defining slots 124. Fasteners 122 are passed through the slots 124 and connected to the building structural 112 below in a manner intending to permit the rake plate 116 to displace (or float) relative to the building structural 112 in accordance with previously attempted solutions. In order for the building structural 112 to float, the connected fasteners 122 must permit the slots 124 to move relative to the fasteners 122. More particularly, double arrow 117 is aligned with the direction of the slots 124 to indicate the directions that the rake plate 116 is intended to longitudinally displace in order to compensate for roof and building loads. Importantly, though, at all times the rake plate 116 must be retained within a predetermined lateral disposition relative to the building structural 112. Too little separation with the building structural 112 causes the rake plate 116 to bind up, preventing the longitudinal displacements. Too much separation with the building structural 112 causes failure by peeling away or even separation of the roof assembly from the underlying structurals. The rake plate 116 also has a panel flange 120 extending from the base 118 to which the outermost panel 102 is attached (not depicted).

The extent to which an installer advances the fasteners 122 into the building structural 112 is critical to making the rake plate 116 float on the building structural 112 as intended. Advancing the fastener 122 too much binds the rake plate 116 against the building structural 112, preventing the desired floating construction. Not advancing the fastener 122 far enough reduces the strength of the connection which can cause separation of the roof panel 102 from the building structural 112. This critical construction step is typically performed by a low skilled worked on the construction site, many times with no benefit of training or tooling to ensure that proper connections are being made. With multiple fasteners 122 installed per rake plate 116, the chances are high that mistakes will be made and, in fact, failure analyses have indicated this is a root cause of a significant number of roof assembly failures.

Figure 4:
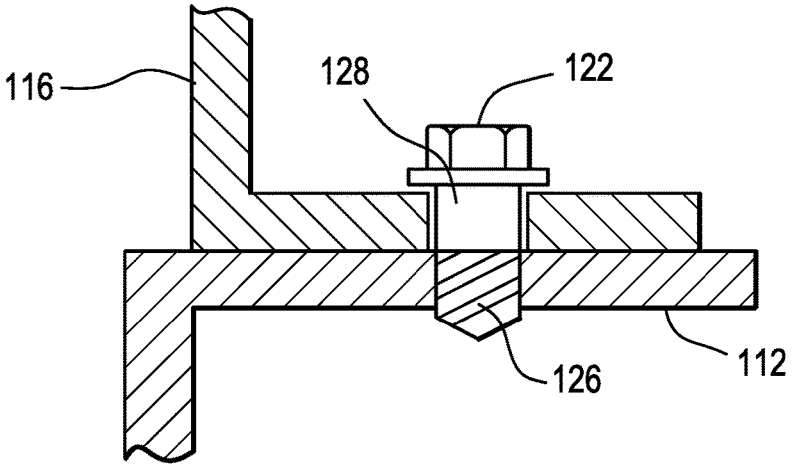
FIG. 4 PRIOR ART
FIG. 4 is a cross sectional depiction of one of the fasteners depicted in FIG. 3.

FIG. 4 is a partial cross-sectional depiction of the previously attempted solutions depicted in FIG. 3. The rake plate 116 is intended to be operably constrained between the head of the fastener 122 and the building structural 112 to which the threaded distal end of the fastener 122 is connected. Note that here and in other similar drawings the amount of clearance between the fastener 122 and the rake plate 116 is exaggerated for purposes of illustrating the intentional sliding clearance permitting the rake plate 116 to float relative to the building structural 112.

In this case the depicted prior art construction relies on the fastener 122 being a shoulder screw, having a threaded distal end forming threads 126 that threadingly engage the building structural 112. The threads 126 are typically a self-drilling type of screw to eliminate the need for pilot holes. The shoulder screw fastener 122 also has an unthreaded shoulder portion 128 adjacent the head that is intended to limit the threaded advancement of the fastener 122. The shoulder portion 128 has a diameter that is smaller than the slot 124 by a desired sliding clearance. The length of the shoulder portion 128 above the building structural 112, after installation, is intended to be greater than the thickness of the rake plate 116 to permit a sliding engagement of the rake plate 116 with the building structural 112. The fastener 122 is intended to guide the direction of rake plate 116 displacement within the extents of the slots 124. However, again, this construction fails if the fasteners 122 are installed too loose or too tight.

Figure 5:
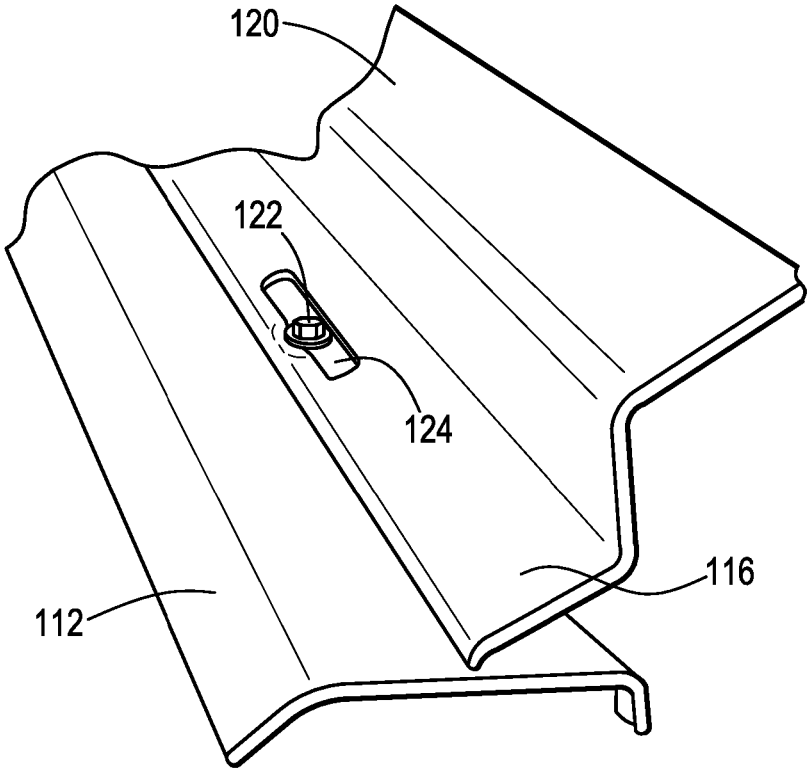
FIG. 5 PRIOR ART
FIG. 5 is an isometric depiction of a failure mode of the previously attempted solution of FIGS. 3 and 4.

FIG. 5 depicts a rake plate 116 attachment gone wrong and causing a roof failure. The rake plate 116 in this case got bound up, preventing the desired floating displacement relative to the building structural 112. Additional loading caused the rake plate 116 to distort sufficiently that it is no longer retained by the fastener 122. Under continued loading without repair, this leads to catastrophic failure when the roof panels 102 peel away and ultimately separate from the underlying structure.

Figure 6:
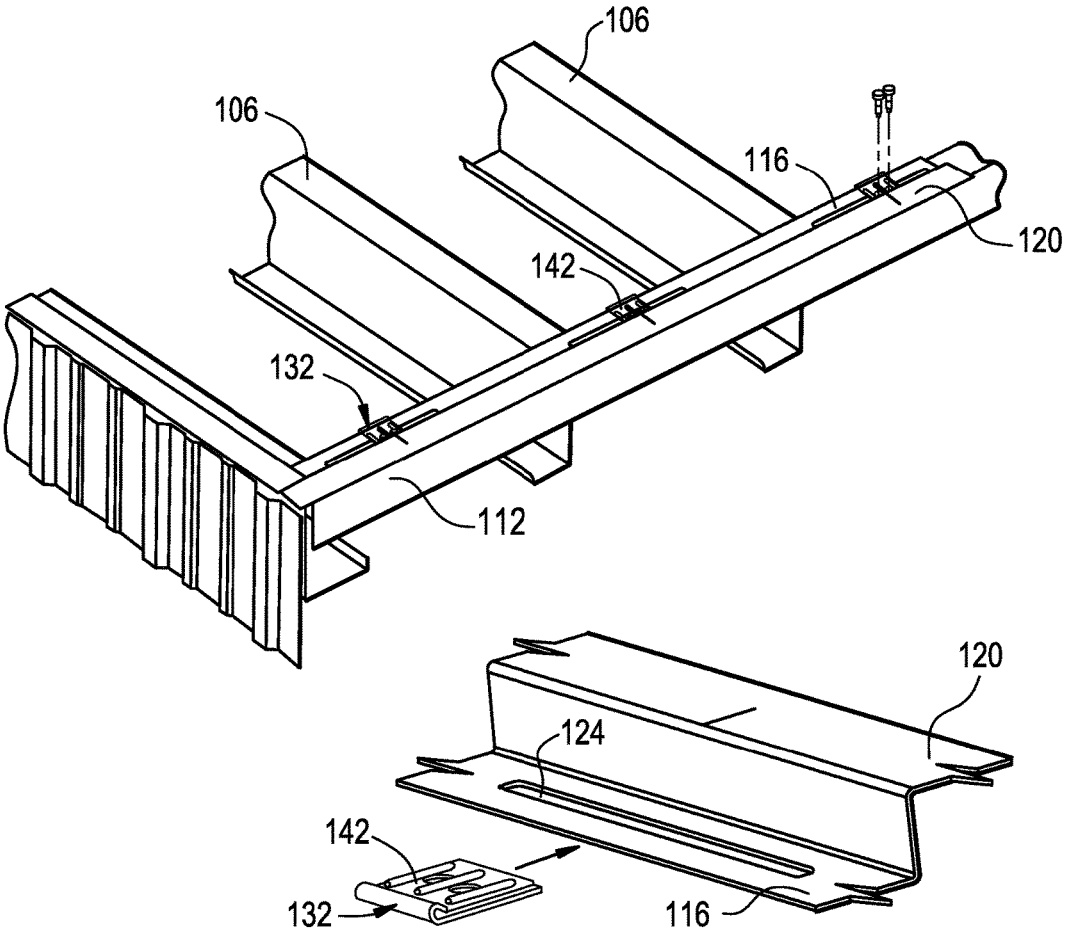
FIG. 6 is similar to FIG. 3 but depicting embodiments constructed in accordance with the technology of this disclosure.
Figure 7A:
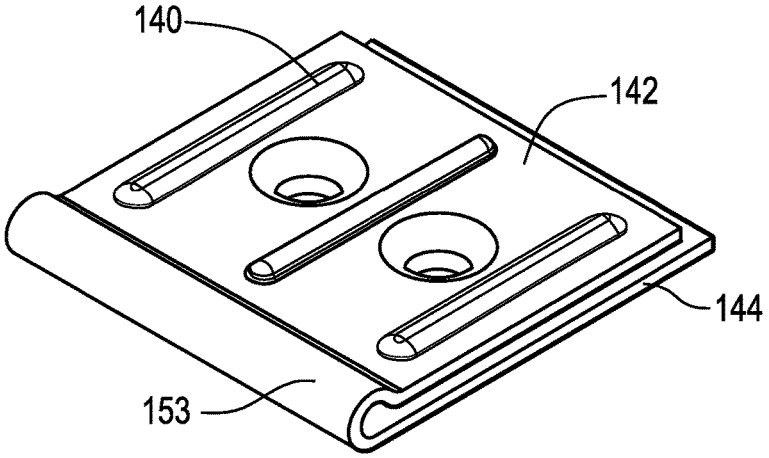
FIGS. 7A-7C depict isometric, top, and cross-sectional depictions, respectively, of the rake plate retainer in FIG. 6 that is constructed in accordance with illustrative embodiments of this technology.
Figure 7B:
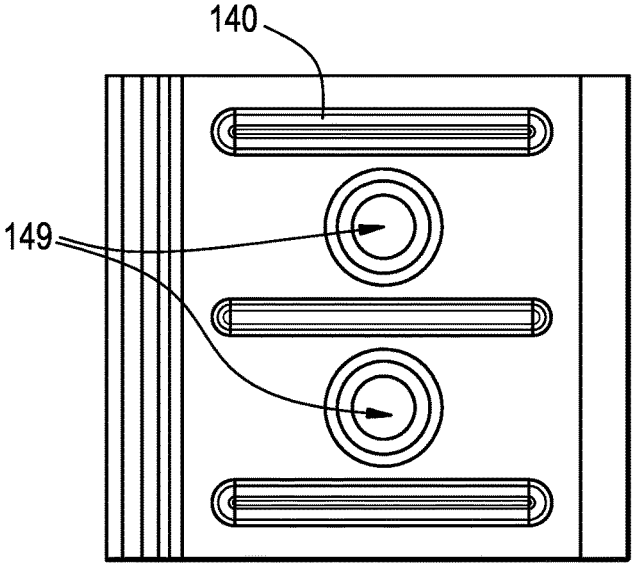
Figure 7C:
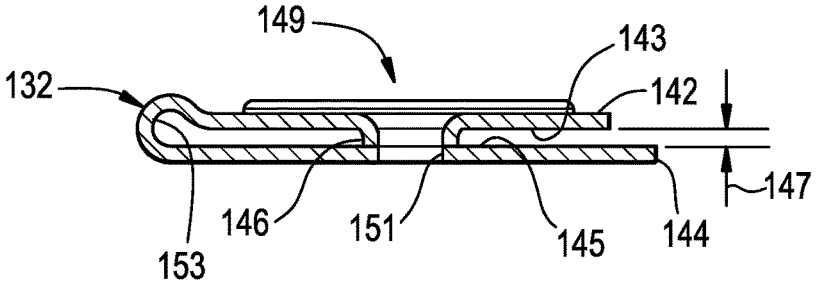
Figure 8:
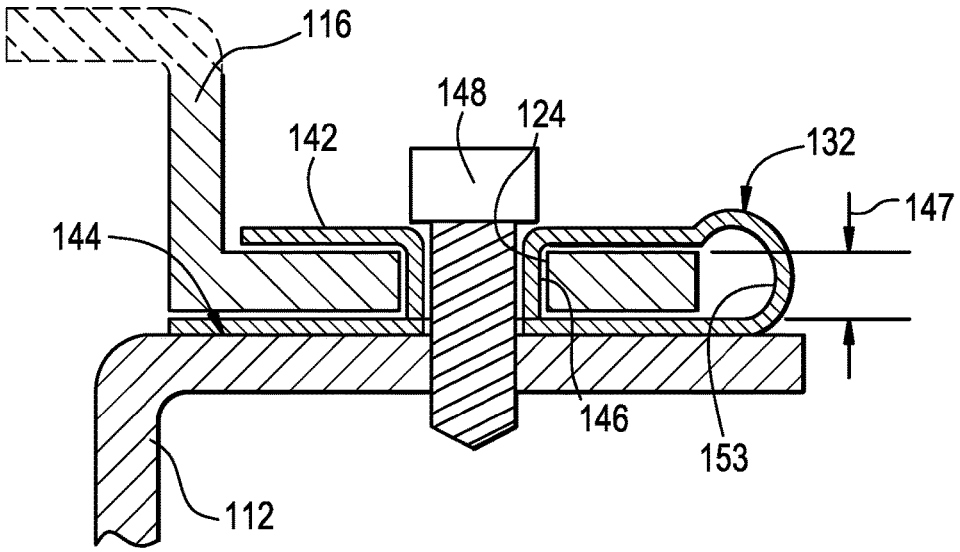
FIG. 8 depicts the rake plate retainer of FIG. 7 operably permitting the rake plate to displace with respect to the building structural.

The present technology resolves these problems of the previously attempted solutions by replacing the specialty fastener 122 with a rake plate retainer having features specifically addressing proper connection and improved strength. FIG. 6 is similar to FIG. 3 except for depicting a rake plate 116 outfitted with a rake plate retainer 132 in each slot 124 that is constructed in accordance with illustrative embodiments of this technology. Although not depicted, some embodiments of this technology contemplate using more than just the one rake plate retainer 132 per slot 124 in order to increase the retention capability. The skilled artisan readily comprehends how the retention capability of this technology can be essentially multiplied by the number of rake plate retainers 132 that are employed, such that an enumeration of all possible combinations of rake plate retainers 132 per slot 124 is not necessary in order to ascertain the scope of the claimed technology.

With respect to FIGS. 7A-7C and 8, the rake plate retainer 132 has a retention flange 142 defining a fastener opening 149 through which a fastener 148 passes to connect to the building structural 112. In these illustrative embodiments the fastener opening 149 is extruded to form a downwardly-directed standoff boss 146 that is designed to abut against a bottom retention flange 144. As the fastener 148 is threadingly advanced into the building structural 112, it urges the top retention flange 142 toward the bottom retention flange 144. The length that the standoff boss 146 extends beyond the bottom surface 143 of the retention flange 142 is designed to maintain a predetermined minimum gap 147 that is greater than the thickness of the rake plate 116 plus the desired clearance that permits a sliding relationship of the rake plate 116 relative to the rake plate retainer 132. In these illustrative embodiments the bottom retention flange 144 does not impede the fastener 148 by defining a clearance opening 151. In these illustrative embodiments the standoff boss 146 is formed as an integral portion of the retention flange 142, but the contemplated embodiments are not so limited. In other embodiments a standoff boss can be formed by or connected to either retention flange 142, 144.

Note that the standoff boss 146 in the contemplated embodiments of this technology is a part of or is connected to the rake plate retainer 132, apart from the fastener 148. That advantageously eliminates the need for specialty fasteners which distinguishes this technology from the previously attempted solutions.

In these illustrative embodiments there are two fastener openings 149 for purposes of increasing the retention force. Experimental use during reduction to practice of the claimed embodiments indicates that superior retention performance is achieved by spacing multiple fastener openings 149 apart by about three hole diameters.

The retention flanges 142, 144 have respective planar surfaces 143, 145 disposed adjacent the top side and bottom side, respectively, of the rake plate 116 which is operably disposed within the gap 147 between the retention flanges 142, 144. These adjacent surfaces 143, 145 define retention zones of the rake plate 116. For purposes of this description and meaning of the claims, the retention zone is the area of the rake plate 116 that might contact the rake plate retainer 132 in the event that deformation occurs as the roof assembly 100 is subjected to loading. In these illustrative embodiments, for example, the rake plate retainer 132 defines a retention zone extending effectively the entire width of the slotted base 118 portion of the rake plate 116. That advantageously retains an entirety of the most vulnerable narrow strip of material between the slot 124 and the outer edge of the rake plate 116.

One or more reinforcing embossments (bosses) 140 can optionally be formed in the retention flanges 142, 144 to increase their stiffness, and hence, the retention strength of the rake plate retainer 132. Although the depicted bosses 140 are upwardly directed in FIG. 7B, they could alternatively be formed downward to reduce the retention-zone-defining surface adjacent the rake plate 116 (not shown), thereby reducing the sliding friction between the retention flange and the rake plate 116.

In these illustrative embodiments the rake plate retainer 132 is formed by folding the retention flanges 142, 144 over and toward each other so that they are parallel to each other. To achieve that parallelism with the small gap 147 therebetween an arcuate hinge 153 is integrally formed to connect the retention flanges 142, 144 together.

Figure 9:
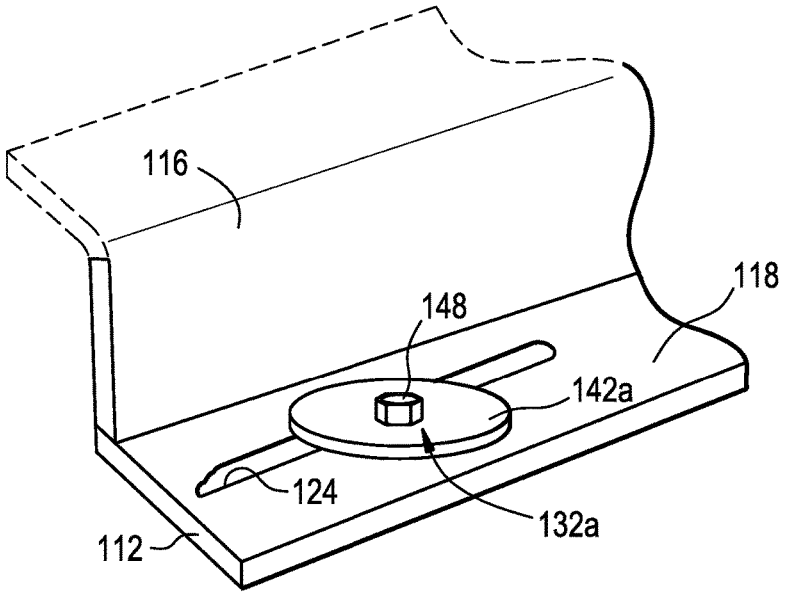
FIG. 9 is an isometric depiction of another rake plate retainer constructed in accordance with illustrative embodiments of this technology.

FIGS. 9-12 depict alternative embodiments of this technology contemplating rake plate retainers having only one retention flange instead of the two discussed in the illustrative embodiments above. FIG. 9 depicts a rake plate retainer 132*a* having a round retention flange 142*a* that also effectively defines a retention zone over the entire width of the base 118 portion of the rake plate 116. The round shape minimizes the retention zone near the upstanding panel flange 120, advantageously reducing the possibility that a pointed corner of the retention flange might bind up against the upstanding panel flange 120 during displacement.

Figure 10:
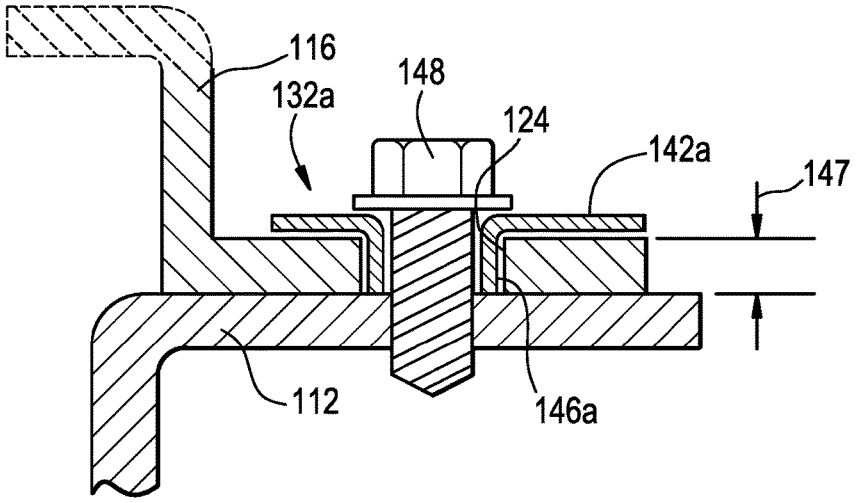
FIG. 10 is a cross sectional depiction of the rake plate retainer in FIG. 9.

FIG. 10 is a cross sectional depiction of the rake plate retainer 132*a* of FIG. 9. Again, in these illustrative embodiments the standoff boss 146*a* is formed as an integral portion of the rake plate retainer 142*a*, but in alternative embodiments it can be connected to, built up onto, or formed onto the retention flange 142*a* portion, and the like. In these alternative embodiments, the standoff boss 146*a* is configured in length to abut against the building structural 112 instead of another retention flange. Similar to that disclosed above, however, the standoff boss 146*a* spatially separates the retention flange 142*a* away from the building structural 112 to maintain no less than the minimum predetermined gap 147 therebetween as the screw is advanced to connect into the building structural 112. That minimum gap 147 permits the operable sliding movement of the rake plate 116 relative to the rake plate retainer 132*a*, and hence relative to the building structural 112, in accordance with the floating plate construction of this technology.

Figure 11:
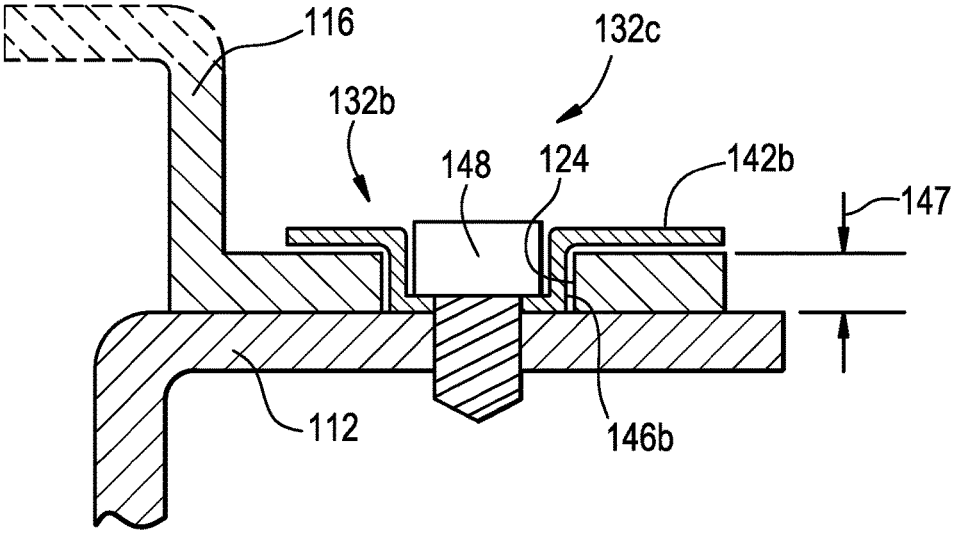
FIG. 11 is a cross sectional depiction of another rake plate retainer constructed in accordance with illustrative embodiments of this technology.
Figure 12:
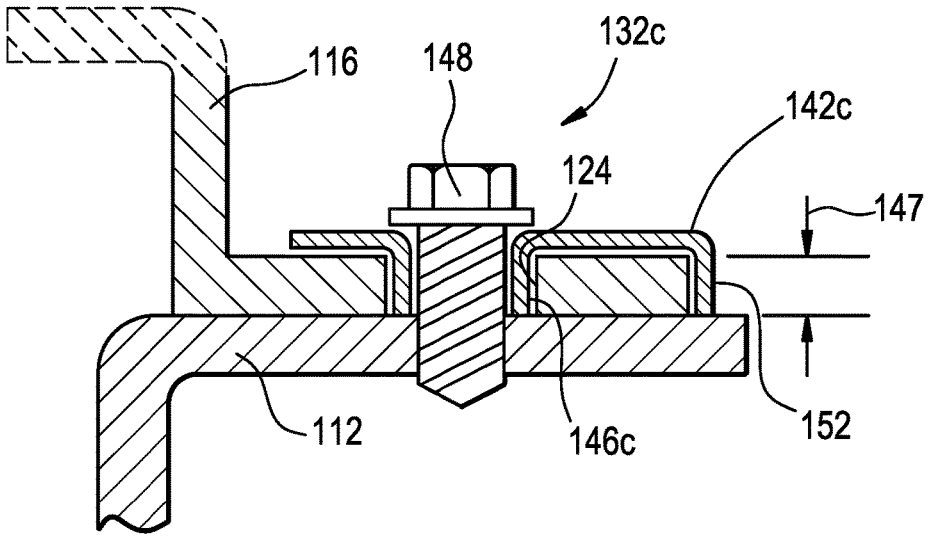
FIG. 12 is a cross sectional depiction of yet another rake plate retainer constructed in accordance with illustrative embodiments of this technology.

FIG. 11 depicts other alternative embodiments of this technology in which the head of the fastener 148 is sized to fit within the slot 124 formed by the rake plate 116. For the compactness of this construction a square drive fastener and the like can be used. Here, the standoff boss 146*b* in the same way is configured in diameter to fit within the slot 124, and configured in length to maintain the minimum gap 147 between the retention flange 142*b* and the building structural 112 to retain the sliding engagement therebetween in support of the floating plate construction of this technology. FIG. 12 depicts yet other alternative embodiments in which a rake plate retainer 132*c* defines a first standoff boss 146*c* within the slot 124 of the rake plate 116 and another standoff boss 152 outside the slot 124 to provide additional stability to the sliding engagement between the rake plate retainer 142*c* and the rake plate 116.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed:

1. A roof assembly, comprising:

a plurality of roof structurals;

a pair of roof panels having adjacent overlapping first edges forming a standing seam that is attached to medial portions of the roof structurals;

a building structural attached to distal ends of the roof structurals;

a rake plate having a planar base portion defining an elongated slot, and further having a panel flange portion extending from the base portion and configured for attaching to an opposing second edge of one of the pair of overlapping a roof panels;

a rake plate retainer having a retention flange defining a fastener opening, and further having a standoff boss extending from the retention flange; and a fastener passing through each of the rake plate retainer's fastener opening and the standoff boss to attach to the underlying building structural, the standoff boss surrounding the fastener inside the rake plate's slot and configured for a sliding clearance relationship with the rake plate portion defining the slot, permitting operable sliding movement of the rake plate relative to the building structural.

2. The roof assembly of claim 1 wherein the rake plate retainer defines a plurality of fastener openings through which a respective plurality of fasteners each passes through and connects to the underlying building structurals.

3. The roof assembly of claim 2 where adjacent fastener openings are separated by a distance of about three diameters of the fastener openings.

4. The roof assembly of claim 1 wherein the retention flange is a first retention flange and further comprising a second retention flange operably disposed adjacent an opposing side of the rake plate.

5. The roof assembly of claim 4 wherein the standoff boss is configured to operably abut against the second flange.

6. The roof assembly of claim 5 wherein the first and second flanges are substantially parallel.

7. The roof assembly of claim 6 wherein the first and second flanges are connected by a hinge.

8. The roof assembly of claim 7 wherein the hinge is arcuate.

9. The roof assembly of claim 8 wherein the hinge and flanges are unitarily constructed.

10. The roof assembly of claim 4 wherein at least one of the flanges comprises a stiffening boss.

11. The roof assembly of claim 1 wherein the standoff boss is configured to operably abut against the underlying building structural.

12. A rake plate retainer operably joining a floating rake plate, defining an elongated slot, to a stationary underlying building structural in a roof assembly, the rake plate retainer permitting a displacement of the rake plate relative to the building structural, the rake plate retainer comprising:

a retention flange defining a fastener opening;

a standoff boss extending from the retention flange; and a fastener passing through each of the fastener opening and the standoff boss to attach to the underlying building structural, the standoff boss surrounding the fastener inside the rake plate's slot and configured for a sliding clearance relationship with the rake plate portion defining the slot, permitting operable sliding movement of the rake plate relative to the building structural.

* * * * *